United States Patent [19]

Plummer et al.

[11] Patent Number: 4,553,738

[45] Date of Patent: Nov. 19, 1985

[54] CABLE PULLING DEVICE WITH ANTI-REVERSING CLUTCH

[75] Inventors: Jeffrey J. Plummer; Larry G. Adleman, both of Rockford, Ill.

[73] Assignee: Ex-Cell-O Corporation, Troy, Mich.

[21] Appl. No.: 646,991

[22] Filed: Sep. 4, 1984

Related U.S. Application Data

[63] Continuation of Ser. No. 435,171, Oct. 19, 1982, abandoned.

[51] Int. Cl.[4] ..... B66D 1/20; B66D 3/16; B66D 5/32

[52] U.S. Cl. ..... 254/358; 254/134.3 FT; 254/376

[58] Field of Search ..... 254/358, 375, 376, 134.3 FT, 254/355

[56] References Cited

U.S. PATENT DOCUMENTS

| | | | |
|---|---|---|---|
| 2,221,903 | 11/1940 | Abramson et al. | 254/134.3 FT |
| 2,422,274 | 6/1947 | Wilson | 254/358 X |
| 2,706,614 | 4/1955 | Gilbert | 254/376 X |
| 3,190,616 | 6/1965 | Oleson | 254/134.3 FT |
| 3,712,431 | 1/1973 | Versoy | 254/375 |
| 3,937,415 | 2/1976 | Prinz | 242/99 X |

*Primary Examiner*—Stuart S. Levy
*Assistant Examiner*—Joseph J. Hail, III
*Attorney, Agent, or Firm*—Edward J. Timmer

[57] ABSTRACT

A cable pulling device includes an anti-reversing clutch between the driving means and capstan to allow the capstan to be rotated by the motor in one direction for cable pulling but preventing rotation of the capstan in the reverse direction by cable loads when driving motor power is interrupted. The anti-reversing clutch prevents breakage of the drive chains and other drive train components.

2 Claims, 2 Drawing Figures

CABLE PULLING DEVICE WITH ANTI-REVERSING CLUTCH

This application is a continuation of application Ser. No. 435,171, filed Oct. 19, 1982, now abandoned.

FIELD OF THE INVENTION

The present invention relates to pulling systems and, in particular, to cable pulling systems for drawing cables, electrical wiring and the like through conduits, trays or raceways. Even more particularly, a cable pulling device is disclosed having improved clutch means to prevent harmful reverse rotation of the capstan and drive train components when the capstan driving means is turned off or interrupted during a pull.

BACKGROUND OF THE INVENTION

Cable pulling devices are well known and have been used in the construction industry to thread or draw electrical cable or wire through conduits, trays or raceways. Conventional cable pulling devices include a strong support frame, a capstan assembly mounted on the support frame and means for driving the capstan assembly. The driving means for the capstan may be a manual crank or an electric motor coupled to a chain and sprocket drive train. Typical cable pulling devices are illustrated in U.S. Pat. No. 2,221,903 issued Nov. 19, 1940 and U.S. Pat. No. 3,190,616 issued June 22, 1965.

In one known cable pulling device, the output shaft of the electric motor drives a pair of chain and sprocket drive assemblies mounted on the support frame. One of the sprockets is connected directly to the capstan for rotating same for cable pulling. This sprocket includes a plurality of radially-extending slots which are spaced apart circumferentially around the sprocket. A spring-biased pawl is mounted on the support frame of the cable pulling device and is adapted to engage the slots during rotation. The pawl is so configured that rotation of capstan sprocket may occur in one direction but not the other. In particular, when viewed from the unsupported end of the capstan, the pawl allows the sprocket to be freely rotated clockwise for cable pulling purposes and restricts rotation in the counterclockwise direction. However, this pawl and sprocket arrangement suffers from the disadvantage that some limited counterclockwise rotation of the capstan and capstan sprocket is possible by virtue of the circumferential spacing existing between the sprocket slots. For example, if the pawl has just disengaged from one of the sprocket slots and the electric motor power source is turned off or otherwise interrupted, the energy associated with the cable being pulled causes a very large counterclockwise force (torque) on the capstan and will cause the capstan to rotate counterclockwise with great speed until the pawl engages into the next circumferentially spaced sprocket slot. This counterclockwise capstan rotation causes a reverse rotation of all drive train components including the motor. When the pawl finally engages, the reverse rotation of the motor and drive train expends its kinetic energy on the components of the drive train system, frequently causing chain breakage or other damage to the drive train components. The pulling operation of course must then be interrupted to replace the chain or repair the damaged components.

SUMMARY OF THE INVENTION

Accordingly, the present invention has as an object the provision of a cable pulling device having means to minimize or prevent harmful, reverse rotation of the capstan assembly from energy associated with the cable when the driving motor pulling force is interrupted under load conditions.

Another object of the present invention is the provision of such a cable pulling device in which the anti-rotation means comprises an anti-reversing clutch means between the driving means and capstan assembly.

A further object of the present invention is the provision of such a cable pulling device in which the anti-reversing clutch means is compact in size so that the overall size of the cable pulling device is not increased.

In a typical working embodiment of the present invention, the cable pulling device includes capstan driving means, a rotatable capstan means rotated by the driving means in one direction to pull cable, and clutch means associated with the driving means for permitting the capstan means to be rotated in the one direction to pull cable but preventing reverse rotation thereof from cable loads when the pulling force exerted by the driving means is interrupted; e.g., when the motor is turned off under load conditions. Prevention of reverse capstan rotation when pulling is interrupted prevents heretofore experience drive chain breakage and damage to other drive train components.

In a particular preferred embodiment of the invention, the anti-reversing clutch means comprised a one-way roller clutch associated with the output shaft of an electric motor. Even more preferred, the roller clutch includes an inner race in which the motor output shaft is received and an outer roller clutch and bearing assembly in which the inner race is received for rotation in one direction but not the other. That is, the roller bearings associated with the outer race are freely rotatable between the races when rotation is in the one direction but the bearings bind in the outer race when rotation is in the opposite direction.

In another preferred embodiment of the invention, the cable pulling device includes a chain and sprocket drive means between the motor output shaft and capstan assembly with the anti-reversing clutch means being operatively associated with the output shaft of the motor means and with a spring-loaded pawl being operatively associatd with a slotted capstan sprocket for engagement with the slots to function as an auxiliary anti-reversing means.

DESCRIPTION OF PREFERRED EMBODIMENTS

Figure 1:
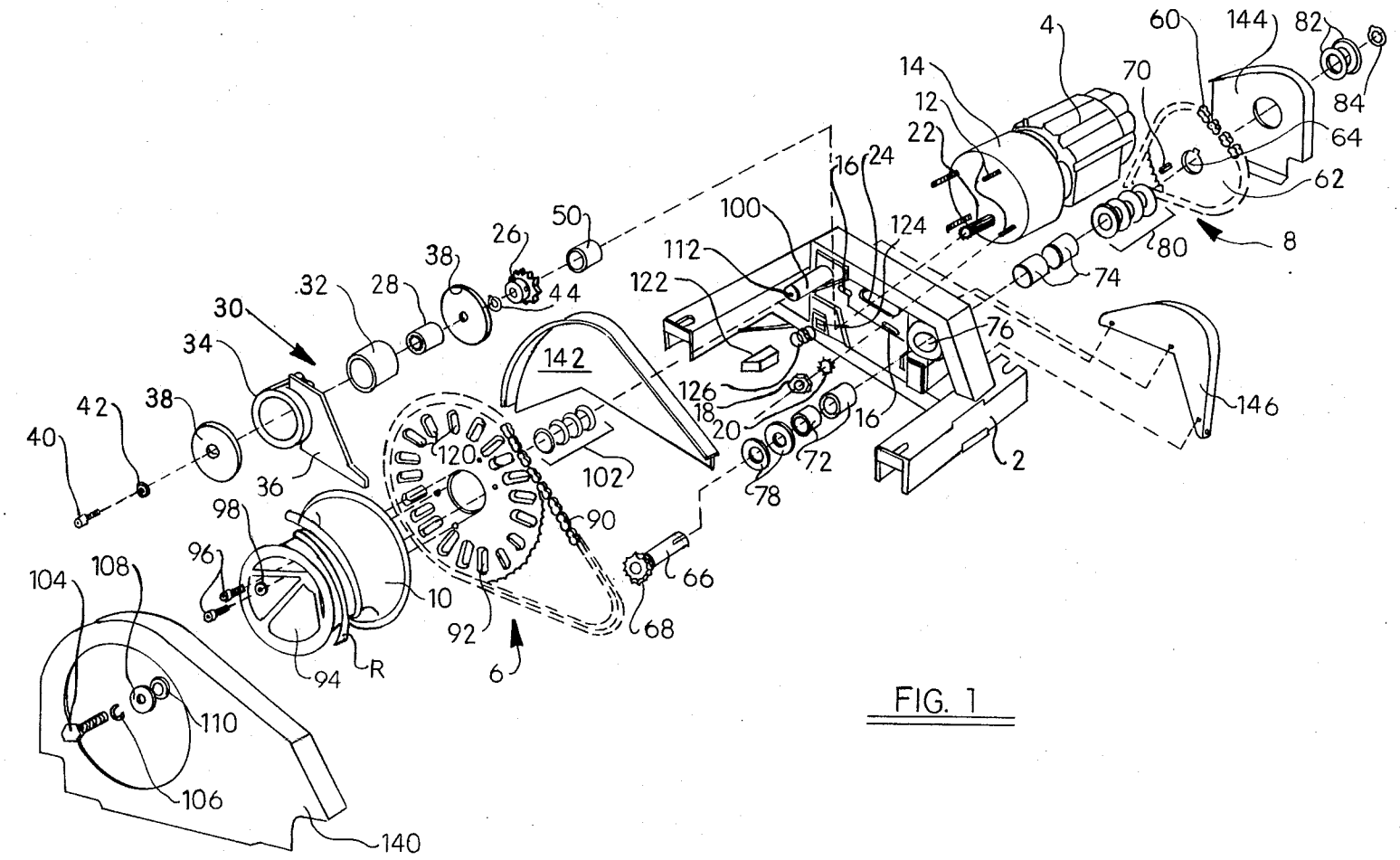
FIG. 1 is an exploded view of a cable pulling device constructed in accordance with the invention.

FIG. 1 is an exploded view of a cable pulling device constructed in accordance with a preferred embodiment of the present invention. The cable pulling device is shown as including a steel support frame 2, and electric driving motor 4, chain and sprocket mechanisms 6 and 8, and a capstan 10 around which rope R is pulled. Rope R is of course connected to the cable being pulled.

The electric driving motor 4 is a conventional 120 volt electric motor of 1½ horsepower and is securely mounted to the support frame 2 by a plurality of threaded studs 12 extending from the motor housing 14. The threaded studs 12 are received in corresponding slots 16 in the support frame and lock nuts and washers 18 and 20, respectively, (only one pair being shown) are used on studs 12 to secure the motor housing to support frame 2. The motor includes a splined output shaft 22 which extends through slot 24 in the support frame and is drivingly received in sprocket 26 of the chain and sprocket mechanism 8 with a portion extending out of the sprocket 26 into and received by inner race 28 of anti-reversing clutch mechanism 30.

The clutch mechanism includes the inner race 28 in which output shaft 22 is received in splined relation and outer roller clutch and bearing assembly 32 in which the inner race is received for rotation in a clockwise direction but cannot rotate in a counterclockwise direction. The outer roller clutch and bearing assembly 32 in turn is non-rotatably received in housing 34 which includes extension 36 which is retained against rotation in a slot in the support frame 2. A pair of washers 38 close off the opposite side openings of the housing 34 and are attached by screw 40 and washer 42 to output shaft 22. A retainer ring 44 is also provided between the inboard washer 38 and sprocket 26 to maintain the clutch components in position on the output shaft 22. Similarly, spacer 50 is provided to maintain the sprocket 26 at the proper location.

Figure 2:
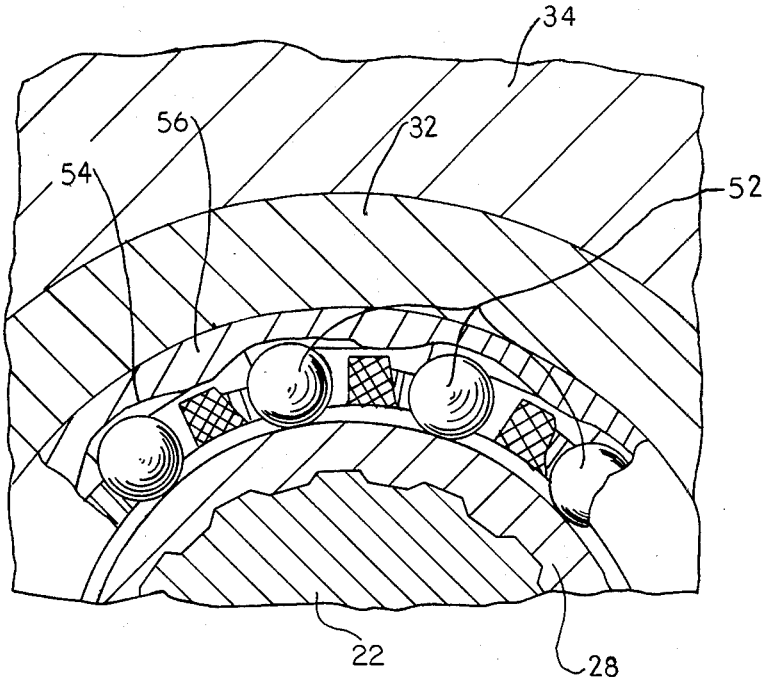
FIG. 2 is a fragmentary cross-sectional view of the roller clutch mechanism.

The outer roller clutch and bearing assembly 32 and inner race 28 are shown in more detail in FIG. 2 and includes rollers 52 received in special locking ramps or grooves 54 in outer race 56. In this assembly, rollers 52 can freely rotate between outer and inner races 56 and 28 when the inner race is rotated clockwise by output shaft 22, but the rollers will bind between the inner race and ramps 54 when the inner race is rotated counterclockwise by, for example, cable loading when the power to motor 4 is turned off or otherwise interrupted during the pulling operation. As will be explained more fully hereinbelow, this binding action prevents the chain and sprocket mechanisms 6 and 8 and capstan 10 from rotating counterclockwise and prevents chain breakage and other possible damage to these drive train components from cable loads when the motor 4 is turned off during a pull. The roller clutch and bearing assembly 32 is of conventional construction and commercially available (e.g., Torrington #FCB-35 roller clutch and bearing).

As will be apparent from FIG. 1, the sprocket 26 is operatively engaged to drive chain 60 which in turn drives large sprocket 62. The large sprocket 62 includes a central, keyed hole 64 in which counter shaft 66 carrying sprocket 68 is received and keyed by key 70. The shaft 66 is rotatably received in a pair of inner races 72. Needle bearings 74 are positioned between inner races 72 and bore 76 in the support frame 2. Thrust washers 78 and 80 are provided on shaft 66 for conventional purposes. And, washers 82 and retainer ring 84 are also provided to hold the aforementioned components on shaft 66 in usual fashion.

It is apparent that sprocket 68 is meshed with drive chain 90 engaging large capstan drive sprocket 92. The sprocket 92 is fastened to capstan hub 94 by multiple machine screws 96 and lock washers 98 to drive same. The capstan 10 is itself rotatably mounted to spindle 100 on the support frame 2 with thrust washers 102 and capstan retaining screw 104, lock washer 106, washer 108 and shim washer 110. To this end, the spindle 100 includes a threaded hole 112 in its axial end to receive screw 104.

The capstan drive sprocket 92 includes a plurality of radially extending, circumferentially spaced slots 120 which are adapted to be engaged by pawl 122 mounted in a square recess 124 in the support frame with compression spring 126. It will be apparent that the pawl 122 will engage and release from each slot 120 as the capstan 10 and capstan sprocket 92 rotate clockwise but will engage in and not release from a particular slot in the event rotation of the capstan and capstan sprocket is counterclockwise. As discussed hereinbelow, this arrangement provides an auxiliary anti-reversing mechanism in addition to that provided by anti-reversing clutch 30 and operable in the event, however unlikely, that the clutch 30 would fail to stop the rotation when the motor 4 is turned off during a pull.

As shown in FIG. 1, outer and inner guards 140 and 142 are provided to enclose chain and sprocket mechanism 6 while outer and inner guards 144 and 146 are provided for chain and sprocket mechanism 8.

Although not shown, it will be apparent that a suitable chain tension adjustment mechanism can be provided for chain and sprocket mechanism 6 and 8 in addition to chain idler mechanisms. Suitable chain tension adjustment mechanisms and idler mechanisms are well known in the art and have been used in the past on commercially available cable pulling devices.

From the above description, it will be apparent that during cable pulling the electric motor 4 will be actuated to rotate the capstan 10 in the clockwise direction through the drive and clutch mechanisms described. During clockwise rotation, the inner race 28 is freely rotatable and the pawl 122 releases from slots 120 in the capstan sprocket. However, in the event the motor is turned off during the pull or in the event power to the motor is unexpectedly interrupted, the roller clutch 30 will prevent reverse (counterclockwise) rotation of the capstan 10 and drive train components due to loading of the rope when the motor is shut off under load conditions. The chain and sprocket mechanisms 6 and 8 are thus not subjected to the aforementioned reverse rotation kinetic energy forces experienced in cable pulling devices previously used and thus chain breakage is prevented or minimized. The pawl 122 in the event of failure of the roller clutch would function as an auxiliary anti-reversing mechanism to stop reverse rotation of the capstan and drive train components under these conditions by engaging and not releasing from the sprocket slot 120 in which it was next caused to engage by reverse capstan rotation. Importantly, when it is desired to resume cable pulling, the motor 4 can simply be turned on again and the roller clutch 30 and pawl 122 will freely release to permit the desired clockwise rotation of the capstan through the chain and sprocket mechanisms.

While the invention has been described by a detailed description of certain specific and preferred embodiments of the invention, it is understood that various modifications and the like can be made in them within the scope of the appended claims which are intended to also include equivalents of such embodiments.

We claim:

1. A cable pulling device, comprising a support frame, a capstan rotatably mounted on the support frame about a rotational axis, an electric driving motor mounted on the support frame and having an output shaft rotatable about an output rotational axis substantially parallel with the rotational axis of the capstan, a chain and sprocket means between the output shaft and capstan, said means having a first sprocket mounted on the output shaft and driven thereby and having a second sprocket attached to the capstan for rotating same in one direction to pull cable when the driving motor is actuated, and an anti-reversing roller clutch means including a housing with a lateral extension member mounted thereon extending transversely of the rotational axis of the capstan and output shaft, said extension member fixedly retained on the support frame against rotation and with a housing bore within said housing coaxially aligned with the output shaft for receiving the output shaft, an inner race in said housing bore mounted on the output shaft for rotation therewith and an outer roller clutch and bearing assembly with a non-rotatable outer race in said housing bore and bearings between said inner race and outer race for rotation in said one direction when the driving motor is actuated for cable pulling but said bearings binding between the inner race and outer race when rotated in the reverse direction so as to prevent rotation of said inner race and thereby lock said output shaft, chain and sprocket means and capstan against rotation in the reverse direction, preventing rotation thereof in the reverse direction by cable loads when the driving motor power is interrupted.

2. The cable pulling device of claim 1 wherein the second sprocket includes circumferentially spaced apertures and a spring-loaded pawl is mounted on the frame member to engage the apertures and permit capstan rotation in said one direction but not the other.

* * * * *